United States Patent [19]

Nieuwstad

[11] Patent Number: 4,712,613

[45] Date of Patent: Dec. 15, 1987

[54] DOWN-HOLE BLOW-OUT PREVENTERS

[75] Inventor: Ronald L. Nieuwstad, Stavanger, Norway

[73] Assignee: Peder Smedvig Aksjeselskap, Stavanger, Norway

[21] Appl. No.: 872,276

[22] Filed: Jun. 10, 1986

[30] Foreign Application Priority Data

Jun. 12, 1985 [GB] United Kingdom ..... 8514887

[51] Int. Cl.[4] ..... E21B 34/06

[52] U.S. Cl. ..... 166/53; 166/72; 166/187; 166/321

[58] Field of Search ..... 166/53, 72, 187, 321, 166/325, 331, 332, 374; 175/24

[56] References Cited

U.S. PATENT DOCUMENTS 3,746,097 7/1973 Mott ..... 166/374
4,161,215 7/1979 Bourne, Jr. et al. ..... 166/53
4,420,159 12/1983 Wood ..... 166/187
4,422,618 12/1983 Lawson ..... 166/321
4,553,589 11/1985 Jennings et al. ..... 166/53
4,566,478 1/1986 Deaton ..... 166/332

*Primary Examiner*—Stephen J. Novosad
*Assistant Examiner*—William P. Neuder
*Attorney, Agent, or Firm*—Fulwider, Patton, Rieber Lee & Utecht

[57] ABSTRACT

A down-hole blow-out preventer has a housing (10) which is engageable in a drill string and which has a ball-valve (13) pivotally mounted in the bore (11) of the housing. The ball-valve is rotated from an open to a closed position by means of a cooperating cam sleeve (20) which is moved downwardly when mud pressure in the borehole is exposed to the flanged end (22) of the cam sleeve, which occurs when a solenoid valve (26) opens up a passage (27) upon a signal being received by a down-hole unit (39).

17 Claims, 3 Drawing Figures

DOWN-HOLE BLOW-OUT PREVENTERS

This invention relates to a down-hole blow-out preventer.

A down-hole blow-out preventer is a device for isolating a zone in a borehole in the event of an influx, or increase in formation pressure, when there is insufficient balancing pressure being exerted on the formation by the hydrostatic head of the drilling fluid. The device enables the bore hole to be sealed off by means of an inflatable packer, which isolates the underbalanced zone, whilst the drilling fluid above the packer is circulated to a higher density until it has sufficient hydrostatic head to overbalance the formation pressure. When the appropriate overbalance has been achieved the packer can be deflated.

One known technique for inflating the packer when an influx is detected involves dropping a ball or bar down the drill string from the surface. The problem with this technique is that it is very slow acting, because it may take an hour for the ball or bar to fall through the mud to its seat.

An alternative technique is suggested in published European Application No. 00116443 where the down hole device has a one-way valve at the bottom which shuts automatically when there is an excess formation pressure. There is a further valve, above the one-way valve, which is closable to allow inflation of the packer and higher density mud circulation, and the device is operated by manipulation from the surface of the well bore pressure.

According to the present invention there is provided a down-hole blow-out preventer comprising a housing having a bore therethrough for the passage of drilling mud and means for connecting the housing into a drill string, inflatable packer means for sealing off the bore hole, valve means for closing the bore of the housing, pressure operated means to actuate the valve means, which pressure operated means is normally isolated from the pressure down the well, and means operable by a signal to expose the pressure operated means to the pressure down the well upon detection of an influx to actuate the valve means and close the bore of the housing.

Figure 1:
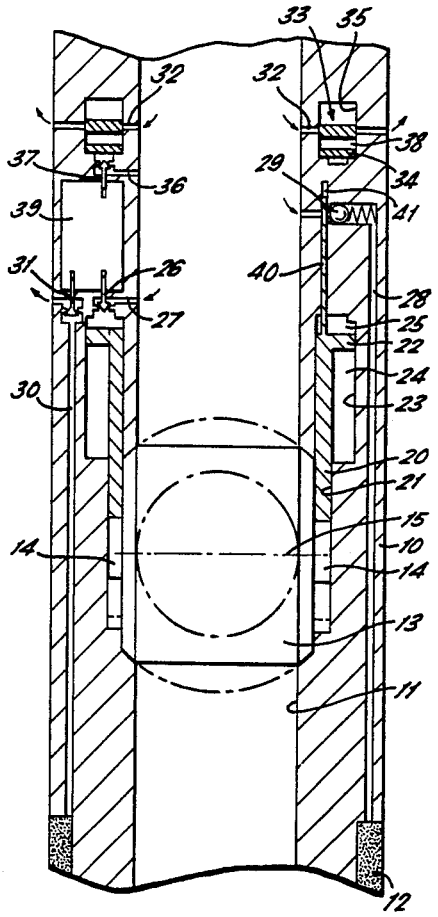
Figure 2:
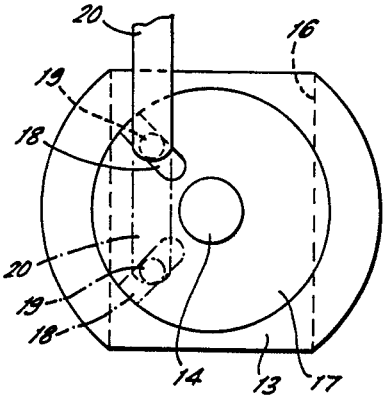
Figure 3:
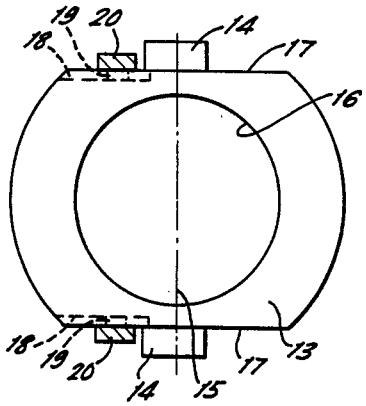

By way of example, an embodiment of the invention will now be described with reference to the accompanying drawings, in which:

FIG. 1 is a schematic section through a blow-out preventer according to the invention, and FIGS. 2 and 3 are views showing the ball valve of FIG. 1 in detail.

A down-hole blow-out preventer comprises a cylindrical housing 10 having a bore 11 therethrough for the passage of drilling mud. At either end, the housing 10 has suitable connections (not shown) which enable it to be connected into a drill string. Towards its lower end the housing 10 has a packer element 12 which is of the well known type that is inflatable into engagemenet with a bore hole. The packer element is inflated in the event of encountering an influx in a higher pressure zone while drilling, to isolate the zone from the annulus and allow higher density mud to be circulated in the annulus until there is sufficient hydrostatic pressure in the mud column to over balance the zone formation pressure. The packer is deflated when a suitable hydrostatic head in the mud column has been achieved.

In the bore 11 of the housing 10 there is a valve 13 which is rotatably mounted on a pair of pins 14 for pivotal movement about an axis 15 which lies normal to the bore of the housing. The valve 13 is of a ball type which seats spherically in the bore 11 of the housing 10 and opens or closes the bore 11. As seen in more detail in FIGS. 2 and 3, there is a through bore 16 in the valve 13 extending perpendicular to the pivotal axis 15 of the valve. Each pivot pin 14 extends from a flat 17 on the side of the valve 13, and in each flat there is a radially extending slot 18. Each slot 18 is designed to be engaged by a lug 19, the pair of lugs 19 being provided on an actuating cam 20. As can be seen in FIG. 2, this arrangement means that axial movement of the actuating cam 20 causes the valve 13 to rotate through 90° between an open position (shown in full lines in FIG. 2) and a closed position (shown in broken lines in FIG. 2).

The actuating cam 20 itself is part of a sleeve which is slidably mounted within a recessed portion 21 of the bore 11 of the housing 10 and which has a flanged portion 22 that acts as a piston in a further recessed portion 23. Between the actuating cam 20, the wall of the further recessed portion 23 and the piston portion 22 there is defined a chamber 24. This chamber 24 contains a gas, conveniently air or nitrogen at atmospheric pressure. The annular chamber 25 above the piston portion 22 of the actuating cam 20 is communicable with the bore 11 of the housing 10 above the valve 13 by means of a valve 26 (normally closed) and passage 27. Valve 26 is operated by a solenoid.

A channel 28 leads from the bore 11 of the housing 10 above the valve 13 to the packer element 12: this is the packer inflating channel. The channel 28 is normally completely shut off from the bore 11 of the housing 10 by a stem 40, which is connected to the actuating cam 20 and is movable in a bore 41. When the actuating cam 20 moves down, stem 40 moves down also and this opens a check valve 29 to the bore 11 of the housing. When the fluid pressure within the housing 11 is sufficiently high, the check valve 29 opens and enables the packer element 12 to be inflated by drilling mud flowing through the inflating channel 28 to the packer element. As an alternative, the packer inflating channel 28 could be opened by means of an additional solenoid operated valve.

Another channel 30 leads from the packer element 12 to the annulus around the outside of the housing 10 via a (normally closed) valve 31: this is the packer deflating channel. The valve 31 is operated by a solenoid. When valve 31 is open, the packer element 12 is able to deflate by drilling mud flowing through the deflating channel 30 to the annulus.

Also in the bore 11 of the housing 10, ports 32 lead from the bore to the annulus via a floating valve 33. The valve 33 is normally shut and comprises an annular piston 34 which is axially movable in a chamber 35. The underside of the piston 34 is communicable with the bore 11 of the housing 10 above the valve 13 via a passage 36 and a valve 37. The valve 37 is normally shut and is operated by a solenoid. The space in the chamber 35 above the piston 34 contains gas, conveniently, air at atmospheric pressure. When the valve 37 is open, drilling mud is able to enter the valve 33 below the piston 34 from the bore 11 of the housing 10. With sufficient mud pressure, thus shifts the annular piston 34 of valve 33 upwardly to the open position of valve 33 whereby drilling mud is able to circulate from the bore 11 of the housing 10 through to the annulus via conduits 38 in the piston 34 which align with the ports 32 in the housing 10.

The housing 10 also includes a signal receiving unit 39 which is capable of receiving coded signals from the surface and acting in response to these signals to open or close selectively the valves 26, 37 and 31 by actuating their solenoids. Power for operating the receiving unit 39 may conveniently be provided by a down-hole battery pack incorporated into the drill string, for example, or by means of a down-hole generator in the drill string. Conveniently, the signal receiving unit 39 is of a kind which is able to detect coded mud pulse signals, i.e. shock waves transmitted through the mud column from the surface. This form of communication is already used in the technology of "measurement while drilling" (MWD), where information from down-hole sensors is sent to a surface detector by means of coded mud pulse signals. In MWD systems, the coded mud pulse signal is transmitted from down in the bore hole usually by some kind of control valve acting to interrupt the flow of drilling mud, or venting or otherwise creating a pressure pulse in the mud column. In the case of the present device, coded mud pulse signals are transmitted to the receiver unit 39 down hole conveniently by means by an accumulator system which is installed on the standpipe manifold.

An alternative system of signal transmission is by electrical current through the mud column or down the drill string itself to a downhole receiving unit.

Operation of the blow-out preventer shown in FIG. 1, assuming that an influx or "kick" is detected in the conventional manner, i.e. at the surface, is as follows:

Upon detection of a potential "kick" situation (as by increased penetration rate, increased mud flow, or detection of gas, etc), the bore hole is shut in by closing the surface blow-out preventers and closing off the drill pipe. The bore hole pressure is determined; if this is zero, the mud column is balancing the formation pressure and drilling can continue. If, however, an overpressure is established, meaning that insufficient hydrostatic pressure is currently being exerted by the mud column, then a coded mud pulse signal is generated by the surface accummulator system and transmitted through the mud column to the receiving unit 39 downhole. The mud pulse signal is decoded by the receiving unit 39 which then actuates the solenoid to open valve 26. This allows the hydrostatic pressure of the mud column to act on the piston portion 22 of the actuating cam 20. The actuating cam 20 moves downwardly, compressing the gas in chamber 24 as it does so, and causing the ball valve 13 to rotate to its position closing off the bore 11 of the housing 10. With the drill-pipe now closed at the bottom, a further pressure increase above the valve 13 will act to open the check valve 29, as stem 40 has moved down with the actuating cam 20 to unblock the check valve 29 from the bore 11 of the housing 10. This allows the packer element 12 to be inflated to the appropriate pressure (about 1500 psi). Once the packer element 12 has been fully inflated, thereby sealing off the high pressure zone below it, a second coded mud pulse signal is generated by the surface accummulator system and transmitted through the mud column to the receiving unit 39 down-hole. This time, upon decoding the signal, the receiving unit 39 actuates the solenoid to open valve 37. This allows the hydrostatic pressure of the mud column to act on the underside of the annular piston 34 of floating valve 33 which duly moves upwardly, compressing the gas in the chamber 35 above the piston 34 as it does so. Valve 33 thus moves to its open position, thereby putting the bore 11 of the housing 10 into communication with the annulus through ports 32 and conduits 38 in the piston 34. This enables higher density mud to be circulated through the bore of the drill string and into the annulus in order to gain sufficient hydrostatic pressure in the mud column to balance the formation pressure, in the conventional way. Once the desired balance is reached with the hydrostatic head in the mud column, the packer element 12 can be deflated. This is done by transmitting a third coded mud pulse signal from the surface accumulator to the receiving unit 39 down-hole. Upon decoding this signal, the receiving unit 39 actuates the solenoid to open valve 31, which enables the high pressure mud which was keeping the packer element 12 inflated to escape to the annulus, thereby deflating the packer element. The blow-out preventer can then be retrieved from the well.

The above described device and method of dealing with an influx still requires surface control; preferably, however, the device itself has means which enable it to detect on influx automatically using one or more sensors downhole. The sensors monitor such factors as mud weight, pH value, temperature, bottom hole pressure, salinity, resistivity and there is conveniently also a sonic (forward looking) detector. The sensors are conveniently electronic and powered by means of a heat-shielded battery pack down-hole or turbine driven generator. Preferably, the sensors are capable of operating in both static and dynamic modes. A processing unit is provided down-hole which is capable of gathering information picked up by the sensors and transmitting it to a compatible unit on the surface. Signals are sent from the processing unit to the surface in the form of coded mud pulses (i.e. pressure waves) through the mud column, the signals being generated by a suitable accumulator or valve transmitter device down-hole. The surface processing unit thus is able to give a warning to the driller of when an influx is imminent so that appropriate steps can be taken at an early stage to operate the blow-out preventer.

I claim:

1. A down-hole blow-out preventer of the kind having means for connection into a drill string for use therewith in a bore hole, said blow-out preventer comprising:

a housing formed with a bore extending through said housing for the passage therethrough of drilling fluid;

means for connecting said housing into a drill string so that the bore of the housing communicates with the bore of the drill string;

packer means inflatable into engagement with the bore hole to form an annular seal between said bore hole and the housing;

and bore closure means for closing off the bore of the housing, said bore closure means including a bore closure member movably mounted in the bore of the housing, a piston mounted for movement in a cylinder in the housing, said piston being operatively connected to said bore closure means and being movable between a first position in which the bore of the housing is open and a second position in which the bore closure means closes off the bore of the housing, means for communicating said cylinder on one side of the piston with the bore of the housing, said cylinder on the other side of the piston defining a chamber which contains a compressible fluid, and first valve means normally isolating said communicating means and operable by a signal to open said communicating means to expose said piston to said fluid pressure in the bore of the housing to cause the piston to move to its second position to close off the bore of the housing.

2. A device as claimed in claim 1 wherein said chamber contains gas at atmospheric pressure.

3. A device as claimed in claim 1 wherein said communicating means is situated in said housing above the bore closure member.

4. A device as claimed in claim 1 wherein said first valve means operable by a signal comprises a solenoid valve which is associated with means for receiving signals, which signal receiving means is operable to actuate said solenoid valve.

5. A device as claimed in claim 1 and further comprising means to allow inflation of the packer means, comprising a one-way valve between the bore of the housing and the packer means, which one-way valve allows inflation of the packer means but prevents deflation of the packer means.

6. A device as claimed in claim 5 wherein the means to allow inflation of the packer means includes means for isolating the one-way valve from the bore of the housing to prevent accidental inflation of the packer means.

7. A device as claimed in claim 6 wherein the isolating means is automatically removed to expose the one-way valve to the bore of the housing when the bore closure means is actuated to close the bore of the housing.

8. A device as claimed in claim 1 and further comprising means to allow circulation of drilling fluid through the bore of the housing to the annulus in the bore hole around the housing, which means comprises second valve means which is associated with means for receiving signals, which signal receiving means is operable to actuate said second valve means.

9. A device as claimed in claim 8 wherein said second valve means comprises a solenoid valve.

10. A device as claimed in claim 1 and further comprising means to allow deflation of the packer means, which means comprises third valve means.

11. A device as claimed in claim 10 wherein the means to allow deflation of the packer means is associated with means for receiving signals, which signal receiving means is operable to actuate said third valve means.

12. A device as claimed in claim 10 wherein said third valve means comprises a solenoid valve.

13. A device as claimed in claim 11 wherein the signal receiving means is provided as a single down-hole unit which is carried by the housing and which is operable to actuate the first, second and third valve means.

14. A device as claimed in claim 13 wherein the down-hole unit receives signals form the surface, which signals are transmitted as pressure waves through the column of drilling fluid.

15. A device as claimed in claim 14 wherein said pressure waves can be coded to cause the down-hole unit selectively to actuate a desired one of the first, second and third valve means.

16. A device as claimed in claim 1 and further comprising down-hole sensor means capable of detecting an influx down-hole, and means for transmitting a signal to the surface upon detection down-hole of an influx.

17. A device as claimed in claim 16 wherein the housing has means for automatically generating a signal when an influx is detected down-hole to operate the bore closure means and close off the bore of the housing.

* * * * *